US006405999B1

(12) United States Patent
Curran

(10) Patent No.: US 6,405,999 B1
(45) Date of Patent: Jun. 18, 2002

(54) CONVERTIBLE STOP FOR A FLOOR COVERING STRETCHING APPARATUS

(75) Inventor: Thomas A. Curran, Wilmington, DE (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 43 days.

(21) Appl. No.: 09/712,711

(22) Filed: Nov. 14, 2000

(51) Int. Cl.[7] ..... B65H 77/00
(52) U.S. Cl. ..... 254/200; 294/8.6
(58) Field of Search ..... 254/200, 201, 254/206, 209, 210, 211, 212; 294/8.6

(56) References Cited

U.S. PATENT DOCUMENTS 1,952,218 A 3/1934 Peterson
2,631,403 A * 3/1953 Hopkins ..... 254/200
3,706,440 A * 12/1972 Ross ..... 254/212
4,828,305 A * 5/1989 Gaddy ..... 254/200
5,183,238 A * 2/1993 Sorensen ..... 254/200
5,484,136 A * 1/1996 Lopes et al. ..... 254/200
5,505,433 A 4/1996 Carmichael et al.
5,626,329 A 5/1997 Herdan
5,681,031 A 10/1997 Foley
5,855,361 A * 1/1999 Krowchak ..... 254/209
5,873,614 A 2/1999 Taylor et al.
D413,498 S * 9/1999 Krowchak ..... 254/200
5,984,274 A 11/1999 Medwin

* cited by examiner

*Primary Examiner*—Emmanuel M. Marcelo

(57) ABSTRACT

A stop and method for anchoring a floor covering stretching system and in particular, a power stretcher system. The stop is invertible and has a sufficient beam structure to act as an anchor for a power stretcher for a floor covering whether used as a tail stop against a vertical surface, with the gripper protrusions facing upward and out of contact with the floor covering, or by inverting the stop such that the gripper protrusions are in contact with the floor covering is operable as an anchor at intermediate points, in the room where a vertical surface is unable to be used as a tail stop anchor support.

15 Claims, 3 Drawing Sheets

CONVERTIBLE STOP FOR A FLOOR COVERING STRETCHING APPARATUS

FIELD OF THE INVENTION

The present invention relates generally to a floor covering stretching apparatus, and more particularly concerns an anchoring device for a floor covering stretching apparatus.

BACKGROUND OF THE INVENTION

It is the usual practice when laying a floor covering such as wall-to-wall carpet (whether over a pad or directly over a floor) to attach a first edge of the carpet to the floor adjacent to one wall of the room and to unroll the carpet toward the opposite wall of the room. The carpet attachment may be effected using adhesive, or, as is perhaps more common, by laying the carpet over the upstanding spikes of a "tack strip" that is itself mounted adjacent to the wall. Before the other edge of the carpet is attached, it is necessary to stretch the carpet to eliminate wrinkles or creases in the carpet.

There are a variety of available devices that are used to stretch carpet. In one of the more common devices, a "knee kicker," a force is generated by the impact of the knee of the installer against the device. Other devices, so-called "power stretchers," include some form of linkage arrangement that converts a downward force applied to an operating lever into a generally horizontal stretching force imposed on a stretching head. The power stretcher involves the use of the operator's arms to apply the downward force to the lever.

In order for the displacement of a carpet gripping head from the retracted to the extended position to impart a stretching action to the carpet, the stretching apparatus must be anchored. Only when so anchored and braced will a horizontal stretching force be imposed into the carpet to stretch the carpet with respect to the floor.

It is common practice, to have an abutment surface behind the stretching apparatus to anchor the stretching apparatus. The abutment surface in such cases is usually defined either by the baseboard of a distant wall or by a gripping cleat; known as a "dead man," secured to the carpet behind the stretching apparatus. An extension arrangement bridges the distance between the stretching apparatus and the abutment surface. On the undersurface of the dead man is attached a plurality of tack strips. The spikes of the tack strip extend into the carpet when the undersurface of the dead man is laid on the carpet. In large rooms the extension arrangement is often insufficient to bridge the distance between the stretching apparatus and the abutment surface. The use of the dead man in this instance requires another person to physically hold the dead man in place due to it's tendency to roll.

The following disclosures may be relevant to various aspects of the present invention and may be briefly summarized as follows:

U.S. Pat. No. 5,984,274 to Medwin discloses an apparatus and method for stretching a carpet that includes the application of a downwardly directed actuation force on a foot-operated pedal actuator to generate a horizontally directed carpet stretching force. An extension arrangement included either fixed length and/or adjustable length truss members is used to anchor the carpet stretching apparatus.

U.S. Pat. No. 5,873,614 to Taylor et al. discloses an anchor connectable to a carpet stretching apparatus includes a generally L-shaped member in which a leg defines a base while a second leg forms an upright backstop.

Other devices eliminate the need for an additional person to anchor the carpet stretching apparatus. However, it is believed advantageous to eliminate the additional person and also provide an anchor or stop that is versatile and simple to manipulate such that it is capable of use against a base board and wall as a tail block or tail stop and also as an anchor at intermediate points for a carpet stretcher system without the use of a wall or base board for support. It is also desirable that the anchor or stop have a beam structure sufficient to prevent deformation when the stretching force is applied, particularly at intermediate points without a vertical surface for support.

SUMMARY OF THE INVENTION

Briefly stated, and in accordance with one aspect of the present invention, there is provided a stop for a floor covering stretching apparatus connected thereto using a stretching pole, the stop comprising: at least a three-sided member in which a substantially rigid beam structure dissipates a concentrated stretching force of the stretching pole uniformly over the floor covering width, the at least three-sided member having three sides with two support ends opposite each other and perpendicular to the at least three-sided member: a first side defining a base having a first forward edge, a first backward edge opposite the first forward edge, and an underside thereon, a plurality of inclined gripping protrusions engageable with the floor covering and floor covering backing being attached to the underside of the base, the gripping protrusions being inclined from the first forward edge toward the first backward edge; a second side defines a top located directly above and parallel to the first side, the second side having a second forward edge and a second backward edge; a third side, having a top edge and a base edge opposite the top edge, is perpendicularly positioned between the first backward edge and the second backward edge being directly opposite and parallel the first backward edge, forming an upright back member, the third side being connected to the first backward edge along the base edge and the second backward edge along the top edge, the first forward edge and the second forward edge being free; two support plates located perpendicular to the first side and second side, each of the support plates having one support edge and a second support edge opposite each other, the one edge coupled to the first side opposite the underside, and the second side, having an inner side, coupled to the second support edge, the two support plates separated by a separating member located parallel to and away from the third side; a tubular connector pivotally connected to the top and the base by pin connections, the tubular connector having a forward end thereon; and the tubular connector being engageable at its forward end with the floor covering stretching apparatus so that a force generated by the floor covering stretching apparatus while stretching a floor covering is transmitted through the tubular connector, and into the beam structure and is reacted upon at the base member by a force at points of application of the gripping protrusions in the floor covering in the direction of inclination thereof.

Pursuant to another aspect of the present invention, there is provided a method of stretching a floor covering, comprising: dissipating a concentrated stretching force of a stretching pole uniformly over a width of the floor covering through a substantially rigid beam structure of an at least three-sided member having three sides with two support ends opposite each other and perpendicular to the at least—three-sided member: a first side defining a base having a first forward edge, a first backward edge opposite the first forward edge, and an underside thereon, a plurality of inclined gripping protrusions, engageable with the floor covering and a floor covering backing, attached to the underside of the base, the gripping protrusions being inclined from the first forward edge toward the first backward edge; a second side defining a top located directly above and parallel to the first side, the second side having a second forward edge and a second backward edge; a third side, having a top edge and a base edge opposite the top edge, perpendicularly positioned between the first backward edge, and the second backward edge being directly opposite and parallel the first backward edge, forming an upright back member, connecting the third side being connected to the first backward edge along the base edge and the second backward edge along the top edge, the first forward edge and the second forward edge being free; coupling two support plates to the first side and second side, the two support plates located perpendicular to the first side and second side, each of the support plates having one support edge and a second support edge opposite each other, the one edge coupled to the first side opposite the underside, and the second side, having an inner side, coupled to the second support edge, the two support plates separated by a separating member located parallel to and away from the third side; attaching a tubular connector pivotally to the top and the base by pin connections, the tubular connector having a forward end thereon; and engaging the tubular connector at its forward end with the floor covering stretching apparatus so that a force generated by the floor covering stretching apparatus while stretching a floor covering is transmitted through the tubular connector, and into the beam structure and is reacted upon at the base member by a force at points of application of the gripping protrusions in the floor covering in the direction of inclination thereof.

Pursuant to another aspect of the present invention, there is provided a method of stretching a floor covering over a flooring surface, comprising:

a) anchoring one end of the floor covering to a desired location of the flooring surface with a fastening means;

b) positioning a stop having a first position and a second position for floor cover stretching in one of the positions, on the floor covering at the desired location, the stop comprising a substantially rigid beam structure for dissipating a concentrated stretching force over a width of the floor covering, the stop pivotally attached to a tubular connector, having a forward end, the forward end being engageable with the floor covering stretching apparatus including a gripping end;

c) attaching removably the gripping end of the floor covering stretching apparatus to another location of the floor covering a distance, predetermined by a length of the floor covering stretching apparatus, away from the stop;

d) stretching the floor covering over the flooring surface such that a force generated by the floor covering stretching apparatus is transmitted through the tubular connector, into the beam structure of the stop distributing the force uniformly across a width of the stop, the force providing a strain for a flat lay or pattern matching of the floor covering;

e) anchoring the floor covering stretched by the floor covering stretching apparatus with a fastening means to the flooring surface;

f) Removing the stop from the floor covering and the floor covering stretching apparatus; and g) Repeating steps a) through f) on another segment of the floor covering until the entire floor covering lays flat or with pattern matching switching between the first position and the second position of the stop as needed.

BRIEF DESCRIPTION OF THE DRAWING

The invention will be more fully understood from the following detailed description, taken in connection with the accompanying drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE DRAWINGS

Reference is now made to the drawings where the showings are for the purpose of illustrating a preferred embodiment of the invention and not for limiting same. The convertible stop of the present invention helps floor covering (e.g. carpet) installers improve efficiency and reduce manpower required to power stretch wrinkles out of the carpet and/or to achieve pattern matching in adjacent strips of carpet. The convertible stop is an anchor providing the resistance force necessary for the carpet or the floor covering being stretched over a flooring surface by a carpet stretching apparatus. The stop is convertible in that it can be used as an anchor in one position abutted against a vertical support surface and by simply inverting (e.g. turning over the stop manually) it can be used in a second position for intermediate points of the flooring surface without a vertical support surface.

Figure 1:
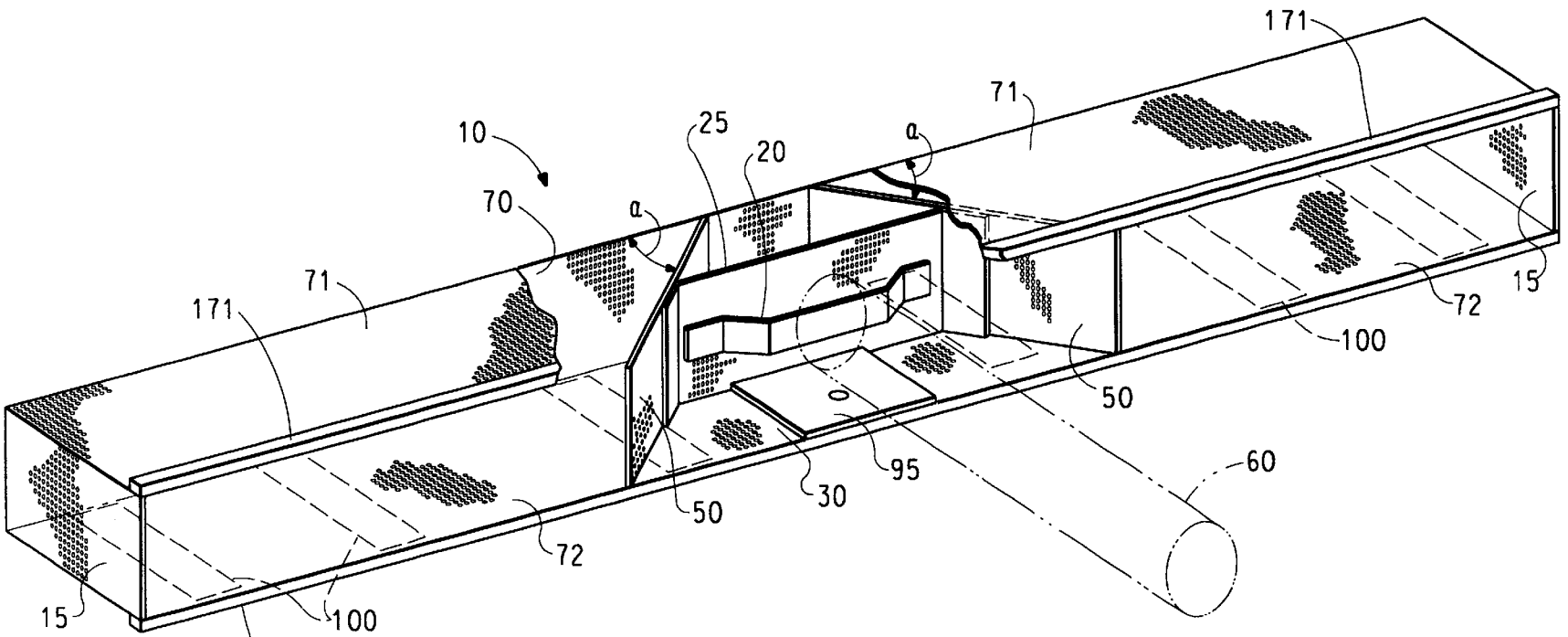
FIG. 1 is a perspective view of the three-sided embodiment of the present invention of the convertible stop in a second position.

Reference is now made to FIG. 1, which provides an illustration of a convertible stop in accordance with the present invention. The convertible stop 10 has at least three sides, a top 71, a base 72, and a third side 70 in between the top and base at the back of the convertible stop 10. The stop is connected to the floor covering stretching apparatus through a tubular connector 60 to a stretching pole (not shown). The convertible stop has a substantially rigid beam structure (i.e. having essentially no lateral bending from a centrally applied, concentrated force.) In a preferred embodiment of the present invention, all of the sides of the stop have a flat surface. The flat surfaces enable adjacent abutment of the stop against the relative surfaces. (I.e. The flat surface of the third side 70 adjacently abuts the vertical support surface and the top 71 and base 72 adjacently contact the floor covering depending upon which position the stop is in.) The stop is made of a rigid material that has essentially no lateral bending from the centrally applied force of the carpet stretching system. Such rigid materials include composite materials made with glass or carbon fibers and metals such as steel, stainless steel and aluminum. For metals it is preferable that the metal is perforated (perforations shown by reference number 11) to reduce the weight of the convertible stop. For ease of use, by a single installer, the weight of the convertible stop is preferably less than or equal to eight (8) pounds. An embodiment of the present invention of the convertible stop measures at least forty (40) inches in length, with the top 71 and the base 72 being at least about 4 inches wide, and the back side 70 of the convertible stop™ being at least 2 inches in height and the sheet metal of the structure being between about 0.04" to about 0.08".

With continued reference to FIG. 1, the three sides of the present invention form a C-shape anchoring device for the floor covering stretching system. The base 72 contains enough gripper inserts 100 to hold the convertible stop securely in place. For example, a stop with at least a 40 inch length as described above, may be securely held in place by about six (6) gripper inserts and can provide a stretching force of about 150 lbs to about 250 lbs for cut pile carpet. The convertible stop anchors more securely on commercial loop pile. Using a similar convertible stop length of about 40 inches and six (6) gripper inserts, a stretching force of about 400 to about 500 lbs occurred. (It was found that applying a momentary force of at least 40 lbs to the convertible stop placed on the cut pile to penetrate the cut pile floor covering with the gripper inserts enabled sufficient force for secure attachment of the stop as indicated above. No such momentary force application is required for commercial loop floor coverings.) While more inserts can be used on a 40 inch length convertible stop it is preferable for the least amount of gripper inserts to be used because it was found that fewer gripper protrusions allow deeper penetration into the carpet. Deeper penetration by the gripper protrusions more securely holds the convertible stop in place preventing roll over or slippage by the stop during carpet stretching. The gripping cleat or insert of the present invention is available from manufacturers such as Taylor Tools of Denver, Colo. 80239, Taylor Model #800-15 Sharks Teeth and Crain Cutter Co. of Milpitas, Calif., 95035, Crain Model #1600-A gripper inserts.

With continued reference to FIG. 1, in the open side of the c-shaped stop, support ribs 50 are located between the top 71 and the base 72 forming an indention or recessed region 30 therein. The support ribs 50 are shown in the breakaway portion of FIG. 1 at an angle. The acute angle a between the support rib and the back side 70 surface ranges from about 55° to about 90°. The angle of the support ribs must accommodate the leaf spring 20. The support ribs 50 are angled to provide for the swing movement of the tubular connector 60 in the convertible stop. Also by placing the support ribs at an angle, the length of the support ribs are longer in the convertible stop providing added support for the beam structure of the convertible stop when the force is applied. However, the support ribs 50 need not be angled, as long as they provide sufficient support for the spring support, or attachment rib 25, located between the support ribs 50 and support the top and base of beam structure. The spring support mount 25 is located parallel to and away from the back side 70. The spring support mount 25 contains the leaf spring 20, which maintains the position of the rearward end of the tubular connector 60 when the convertible stop 10 is coupled to a floor covering stretching apparatus. A carpet stretching apparatus with which the convertible stop 10 may be used is described in U.S. Pat. No. 5,984,274. In a preferred embodiment of the present invention, support ends 15 are located on opposite ends of the stop, and perpendicular to the top and base, for added support to the beam structure.

A further embodiment of the convertible stop is to add a fourth side to the c-shaped anchor forming a rectangular shape (see FIG. 3A) but maintaining the indented portion 30 between the support ribs 50 for connection to the tubular connector 60.

The convertible stop is particularly useful in conjunction with power stretching systems when installing wall-to-wall carpet, or floor covering, in rooms with large dimensions to uniformly stretch the carpet or floor covering into place due to the limited length of the stretching pole available with power stretchers. For long lengths, extending the stretching poles is not feasible due to bending and/or breaking of the stretching pole when the force for stretching is applied. The carpet stretching procedure and apparatus is generally described in U.S. Pat. No. 5,984,274. For large rooms intermediate anchor points in the interior areas, away from the baseboard, wall or other vertical surfaces, of the room from which the power stretcher can exert its force, are required. The versatility and beam structure of the present invention allows the convertible stop to be used both as a tail block or tail stop (i.e. a device or apparatus which abuts against a vertical surface to provide a reaction force to the stretching force) and as an anchor providing the resistance force necessary for carpet stretching in intermediate points not abutting a vertical surface for support. The versatility of the present invention is that the stop can be inverted from one position (e.g. used as a tail stop) to a second position (e.g. used at intermediate anchor points) for carpet stretching. (Inverting means turning the stop over such that the gripping contact side of the stop in position one is out of gripping contact with the floor covering in position two.)

In an embodiment of the present invention, one end of the carpet is initially attached or anchored to the floor at the desired location (e.g. adjacent a wall using tack strips or adhesives) then the carpet is unrolled and stretched to insure a flat lay or pattern matching. A strain of about 1% to about 2% is required for this desired effect. The power stretcher system provides the force to achieve that strain. An adhesive on a cement floor, stay-nails or any similar fastening device may be used to anchor the end of the carpet adjacent to the wall. The stop 10 is then either attached to the carpet at a desired intermediate point location, (e.g. interior to the floor), or used as a tail stop against a baseboard of a wall to provide the required reaction to the stretching force of the power stretching system. Normally, the carpet installer starts at one wall and stretches the carpet progressively to an opposite wall.

For intermediate points of the floor, the stop 10 is attached to the carpet by pressing the base 72 of the stop into the carpet such that the gripper protrusions 90 (see FIG. 3A), located on the base, are firmly engaged with the carpet or both the carpet and the carpet backing. The floor covering stretching apparatus is then engaged with the floor covering at another location appropriate to the pole length of the stretching apparatus described in U.S. Pat. No. 5,984,274. The floor covering is then stretched such that a force generated by the floor covering stretching system is transmitted through the tubular connector 60 to the convertible stop 10. The tubular connector 60 transmits this force to the stop 10 through the reinforcing plates 95 (see FIG. 3), located in the top 71 and base 72 of the stop, into the beam structure of the stop, thus distributing the force uniformly across the stop width. The floor covering, having been stretched, is anchored securely in place with stay-nails or masonry fasteners. Where the stretching apparatus does not permit full coverage of the room by the installed floor covering, i.e., to the opposite wall of the room even with full extension of the pole, the convertible stop is relocated to this intermediate point and anchored beyond the length of the uniformly installed carpet using gripper inserts for engagingly attaching to the floor covering without reliance on the wall or any vertical structure for support of the anchor. The power stretcher can then stretch another segment of carpet length using the convertible stop as an anchor. The process is repeated across the width or length of the carpet (as the case may be) until the stretched carpet is laid next to the wall opposite the first wall. There may be variations in the process whereby carpet is stretched alternately in two perpendicular directions or at other angles more appropriate to the particular room geometry.

Figure 3:
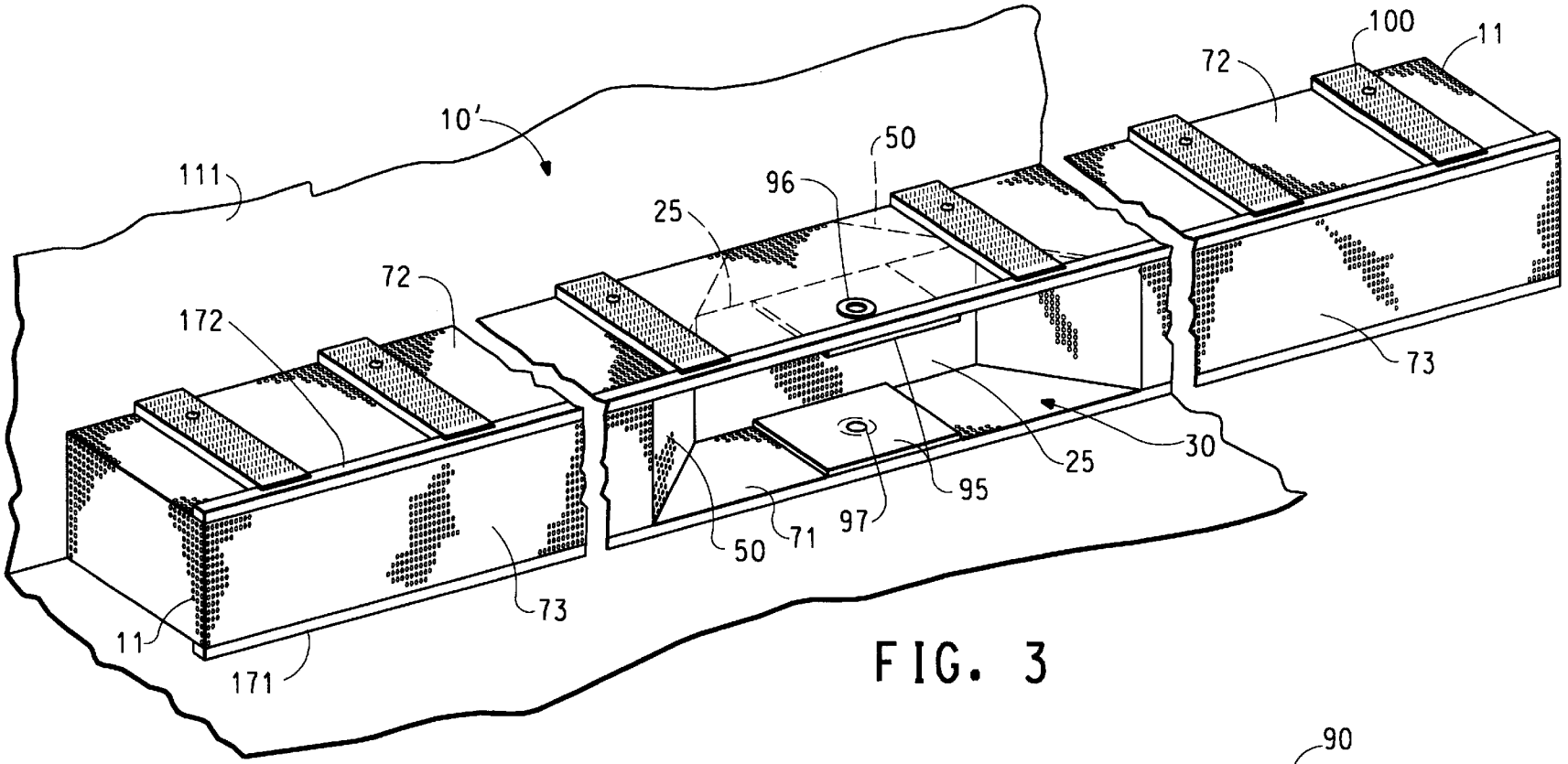
FIG. 3 shows a perspective view of the stop inverted from the second position of FIG. 1 into a first position with the grippers out of contact with the floor covering for use as a tail block.

For use of the carpet stretching apparatus against a vertical surface 111, such as a wall or baseboard, the stop of the present invention is inverted as shown in FIG. 3. The inverted stop 10' is turned over such that the gripper inserts 100 and the gripping protrusions 90 (FIG. 3A) are out of contact with the floor covering. The beam structure of the convertible stop™ is such that the gripper protrusions are not required when the stop is abutted against a wall or like surface. Alternatively, the stop can be used with the gripping protrusions inserted in the carpet at the intermediate points of the carpet. However, it is believed that the life of the gripper inserts is prolonged by turning the stop over and using the stop in the inverted position, against a vertical support surface, with the gripper inserts facing away from the carpet because over time the gripper inserts require replacement from the force applied during use. To prevent marring of the baseboard surface by the stop due to the force of the carpet power stretcher system, it is known to place a protective buffer such as foam or other protective material between the stop and the surface. Both the top 71 and the base 72 contain reinforcing bars 171 and 172, respectively. A benefit of the convertible stop is that it can be moved to intermediate points without causing destructive damage to the floor surface underneath as the gripper inserts, when used, only engage the carpet or floor covering.

Figure 2:
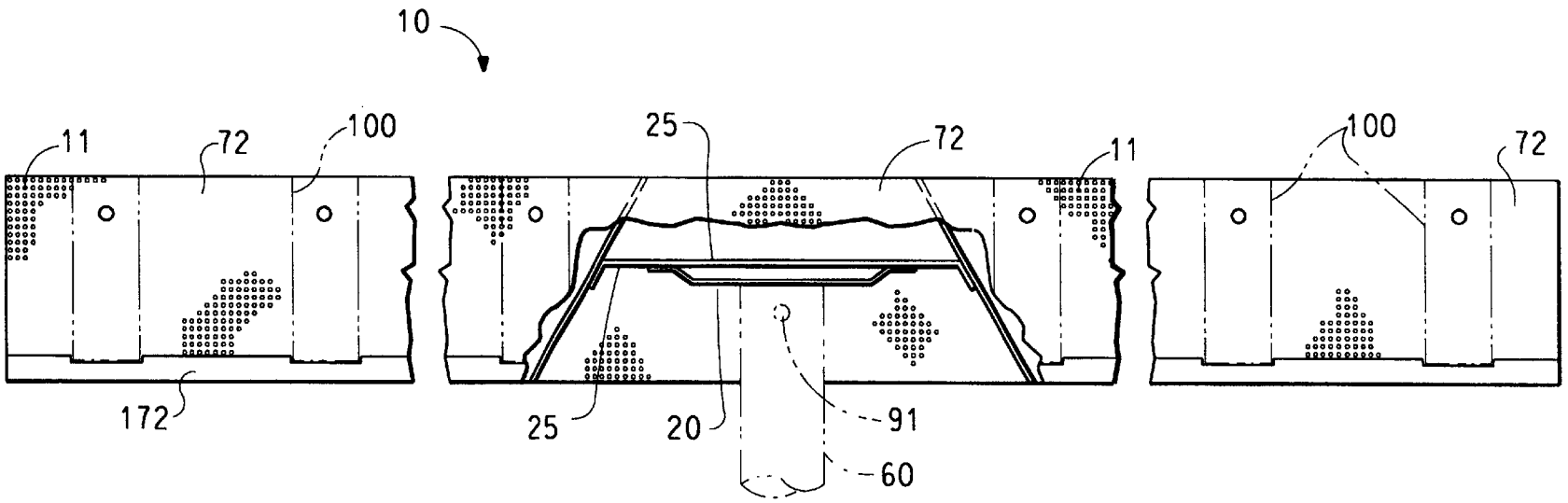
FIG. 2 is a bottom cut-away view of the convertible stop of FIG. 1.

The optional fourth side 73 of the rectangular shaped convertible stop 10 is shown with a recessed area 30 containing the leaf spring mount 25 and the leaf spring 20 (see FIG. 2). The reinforcing bar 172 has a notch at each gripper insert 100 location to resist rotation of the gripper inserts 100 when force is applied. The tubular connector pole 60 (see FIGS. 1 and 2) are held in the recessed portion 30 of the stop 10 by the reinforcing washers 96 at the pole mounting holes 97 through the reinforcing plates 95. For pivotal movement of the tubular connector, two pins are used to hold the tubular connector in place through the vertically aligned mounting holes 97.

Reference is now made to FIG. 2, which shows a cut away of the bottom view of the convertible stop 10. The tubular connector 60 is connected to the convertible stop with spring-loaded detent pins 91. The tubular connector 60 contacts the leaf spring 20, mounted on the spring attachment rib 25 in the recessed region of the convertible stop 10.

Referring again to FIG. 3, which shows the convertible stop 10 inverted from the position of FIG. 1, the top side 71 becomes the base side, and the base side 72 becomes the top side for use as a tail stop. On the underside of the base 72 of the stop 10 are attached a plurality of inclined gripping protrusions 90 such as pins, cleats or like gripping devices which are engageable with the carpet or both the carpet and the carpet backing together depending on the thickness of the carpet.

Figure 3A:
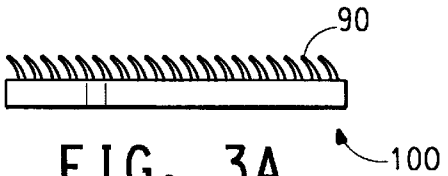
FIG. 3A (PRIOR ART)
FIG. 3A shows an enlarged view of a prior art gripper insert.

Reference is now made to FIG. 3A which shows a detailed view of the prior art gripper insert 100 with gripping pins 90. The gripping pins 90 are inclined in a direction as shown such that the forces from the stretching apparatus into the convertible stop at a point of application is such that gripping pins inclination is to prevent tipping or roll over of the convertible stop. A detailed description of the gripper insert and gripping pins are provided in U.S. Pat. No. 5,873,614.

In recapitulation, the present invention utilizes a convertible stop as an anchoring device for uniformly stretching a floor covering over a floor surface. The convertible stop has a rigid beam structure and is capable of two positions which provides ease of operation due to versatility, size and simplicity, enabling a single installer to stretch the carpet for large and/or standard size rooms by inverting the stop in accordance with the desired location.

It is, therefore, apparent that there has been provided in accordance with the present invention, a convertible stop with versatility for improving the anchoring system of a floor covering system that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. A stop for a floor covering stretching apparatus connected thereto using a stretching pole, the stop comprising:

at least a three-sided member in which a substantially rigid beam structure dissipates a concentrated stretching force of the stretching pole uniformly over the floor covering width, the at least three-sided member having three sides with two support ends opposite each other and perpendicular to the at least three-sided member: a first side defining a base having a first forward edge, a first backward edge opposite the first forward edge, and an underside thereon, a plurality of inclined gripping protrusions engageable with the floor covering and floor covering backing being attached to the underside of the base, the gripping protrusions being inclined from the first forward edge toward the first backward edge; a second side defines a top located directly above and parallel to the first side, the second side having a second forward edge and a second backward edge; a third side, having a top edge and a base edge opposite the top edge, is perpendicularly positioned between the first backward edge and the second backward edge being directly opposite and parallel the first backward edge, forming an upright back member, the third side being connected to the first backward edge along the base edge and the second backward edge along the top edge, the first forward edge and the second forward edge being free;

two support plates located perpendicular to the first side and second side, each of the support plates having one support edge and a second support edge opposite each other, the one edge coupled to the first side opposite the underside, and the second side, having an inner side, coupled to the second support edge, the two support plates separated by a separating member located parallel to and away from the third side;

a tubular connector pivotally connected to the top and the base by pin connections, the tubular connector having a forward end thereon; and the tubular connector being engageable at its forward end with the floor covering stretching apparatus so that a force generated by the floor covering stretching apparatus while stretching a floor covering is transmitted through the tubular connector, and into the beam structure and is reacted upon at the base member by a force at points of application of the gripping protrusions in the floor covering in the direction of inclination thereof.

2. A stop as recited in claim 1, wherein the at least three-sided member is used as a tail block for adjacently contacting a vertical surface to provide a reaction force to the stretching force, the at least three-sided member is turned over such that the second side becomes the base and the first side becomes the top having the gripping protrusions facing upward and out of contact with a floor covering surface such that the vertical surface acts as the support for the third surface, the back member being positioned against the vertical surface.

3. The stop as recited in claim 1, wherein the at least three-sided member forms a c-shape.

4. The stop as recited in claim 1, further comprising a fourth side positioned between and connected to the first forward edge and the second forward edge, the fourth side being opposite and parallel to the third side, the fourth side further defining an aperture centrally located therein having an indented portion, the indented portion of the fourth side being formed by the two support plates and the separating member, the indented position having defined aligned holes allowing engagement of pins with the tubular connector for pivotal movement.

5. A stop as recited in claim 4, wherein the four sided member is used as a tail block for adjacently contacting a vertical surface to provide a reaction force to the stretching force, the four-sided member is turned over such that the second side becomes the base and the first side becomes the top having the gripping protrusions facing upward and out of contact with a floor covering surface such that the vertical surface acts as the support for the third surface, the back member being positioned against the vertical surface.

6. The stop as recited in claim 4, wherein the four-sided member is a rectangular shape.

7. The stop as recited in claim 4, wherein the support plates, each having a third support edge perpendicularly between the one support edge and second support edge, the third support edge being adjacently connected to the third side forming an acute angle $\alpha$ therebetween.

8. The stop as recited in claim 7, wherein the acute angle $\alpha$ ranges from 55° to 90°.

9. The stop as recited in claim 1, wherein the support plates, each having a third support edge perpendicularly between the one support edge and second support edge, the third support edge being adjacently connected to the third side forming an acute angle $\alpha$ therebetween.

10. The stop as recited in claim 9, wherein the acute angle $\alpha$ ranges from 55° to 90°.

11. A method of stretching a floor covering, comprising:

dissipating a concentrated stretching force of a stretching pole uniformly over a width of the floor covering through a substantially rigid beam structure of an at least three-sided member having three sides with two support ends opposite each other and perpendicular to the at least three-sided member: a first side defining a base having a first forward edge, a first backward edge opposite the first forward edge, and an underside thereon, a plurality of inclined gripping protrusions, engageable with the floor covering and a floor covering backing, attached to the underside of the base, the gripping protrusions being inclined from the first forward edge toward the first backward edge; a second side defining a top located directly above and parallel to the first side, the second side having a second forward edge and a second backward edge; a third side, having a top edge and a base edge opposite the top edge, perpendicularly positioned between the first backward edge, and the second backward edge being directly opposite and parallel the first backward edge, forming an upright back member, connecting the third side being connected to the first backward edge along the base edge and the second backward edge along the top edge, the first forward edge and the second forward edge being free;

coupling two support plates to the first side and second side, the two support plates located perpendicular to the first side and second side, each of the support plates having one support edge and a second support edge opposite each other, the one edge coupled to the first side opposite the underside, and the second side, having an inner side, coupled to the second support edge, the two support plates separated by a separating member located parallel to and away from the third side;

attaching a tubular connector pivotally to the top and the base by pin connections, the tubular connector having a forward end thereon; and engaging the tubular connector at its forward end with the floor covering stretching apparatus so that a force generated by the floor covering stretching apparatus while stretching a floor covering is transmitted through the tubular connector, and into the beam structure and is reacted upon at the base member by a force at points of application of the gripping protrusions in the floor covering in the direction of inclination thereof.

12. A method as recited in claim 11, further comprising:

contacting a vertical surface adjacently with the at least three-sided member being used as a tail block to provide a reaction force to the stretching force; and turning the at least three-sided member over such that the second side becomes the base and the first side becomes the top having the gripping protrusions facing upward and out of contact with the floor covering such that the vertical surface acts as the support for the third surface, the back member being positioned against the vertical surface with a foam-cushioned member between the back member and the vertical surface.

13. The method of stretching a floor covering over a flooring surface, comprising:

a) anchoring one end of the floor covering to a desired location of the flooring surface with a fastening means;

b) positioning a stop having a first position and a second position for floor cover stretching in one of the positions, on the floor covering at the desired location, the stop comprising a substantially rigid beam structure for dissipating a concentrated stretching force over a width of the floor covering, the stop pivotally attached to a tubular connector, having a forward end, the forward end being engageable with the floor covering stretching apparatus including a gripping end;

c) attaching removably the gripping end of the floor covering stretching apparatus to another location of the floor covering a distance, predetermined by a length of the floor covering stretching apparatus, away from the stop;

d) stretching the floor covering over the flooring surface such that a force generated by the floor covering stretching apparatus is transmitted through the tubular connector, into the beam structure of the stop distributing the force uniformly across a width of the stop, the force providing a strain for a flat lay or pattern matching of the floor covering;

e) anchoring the floor covering stretched by the floor covering stretching apparatus with a fastening means to the flooring surface;

f) Removing the stop from the floor covering and the floor covering stretching apparatus; and g) Repeating steps a) through f) on another segment of the floor covering until the entire floor covering lays flat or with pattern matching switching between the first position and the second position of the stop as needed.

14. A method as recited in claim 13, wherein the positioning step comprises:

positioning the stop in the first position where the desired location comprises a vertical support surface perpendicular to the floor surface for abutting the beam structure of the stop thereagainst, the vertical surface providing a reaction force to the stretching force of the floor covering stretching apparatus; or positioning the stop in the second position at the desired location free of the vertical support surface such that the beam structure of the stop is engagingly attached to the floor covering, the engagingly attached beam structure providing a reaction force to the stretching force of the floor covering stretching apparatus.

15. A method of claim 13, wherein the first position is the inverting of the stop from the second position of the stop such that the stop is no longer engagingly attached to the floor covering.

* * * * *